US005992707A

United States Patent [19]

Gaichuk

[11] Patent Number: 5,992,707

[45] **Date of Patent: *Nov. 30, 1999**

[54] NOZZLE ACTUATOR

[76] Inventor: Andrew Gaichuk, 63 Greyabbey Trail, Scarborough, Ontario, Canada, M1E 1V8

[ * ] Notice: This patent issued on a continued prosecution application filed under 37 CFR 1.53(d), and is subject to the twenty year patent term provisions of 35 U.S.C. 154(a)(2).

[21] Appl. No.: 08/897,206

[22] Filed: Jul. 15, 1997

[51] Int. Cl.[6] ..... B65D 83/18

[52] U.S. Cl. ..... 222/402.13; 222/402.15; 222/321.8

[58] Field of Search ..... 222/321.8, 402.13, 222/402.15

[56] References Cited

U.S. PATENT DOCUMENTS

| | | | |
|---|---|---|---|
| 3,698,604 | 10/1972 | Nigro | 222/182 |
| 3,987,942 | 10/1976 | Morane et al. | 222/402.15 |
| 4,013,231 | 3/1977 | Van Veldhoven | 239/579 |
| 4,077,548 | 3/1978 | Beard | 222/321 |
| 4,077,549 | 3/1978 | Beard | 222/321 |
| 4,186,855 | 2/1980 | Edman et al. | 222/321 |
| 4,401,240 | 8/1983 | Brack | 222/323 |
| 4,432,474 | 2/1984 | Hutchinson et al. | 222/402.15 |
| 4,606,480 | 8/1986 | Rodriguez Gazulla | 222/341 |
| 4,805,812 | 2/1989 | Brody | 222/402.11 |
| 4,826,054 | 5/1989 | Frutin | 222/402.11 |
| 4,915,263 | 4/1990 | Corba | 222/321 |
| 5,086,954 | 2/1992 | Brody | 222/402.11 |
| 5,323,937 | 6/1994 | Brody | 222/402.11 |

*Primary Examiner*—Kenneth Bomberg
*Attorney, Agent, or Firm*—Blake, Cassels & Graydon

[57] ABSTRACT

A spray nozzle actuator has a fitment for placement on the ring fitting of a spray can, an hinge or resilient portion, a nozzle pressing portion, and an handle portion extending forwardly of, and along the can. The handle is shaped to avoid obstruction of the spray nozzle, such as by having a large aperture through which a cone of spray may flow with little or no impingement. An operator can hold the spray can in the palm of one hand and reach forward with their fingers to grasp the handle. A generally rearward pull on the handle causes the spray can nozzle to move, releasing the spray.

16 Claims, 4 Drawing Sheets

NOZZLE ACTUATOR

FIELD OF INVENTION

This invention relates generally to an actuator for operating a spray dispenser, and in particular to an actuator having a fitment for attachment to a spray container, a member for operating a spray mechanism, and an handle locatable forwardly of the spray container which does not interfere with the spray.

BACKGROUND OF THE INVENTION

Spray dispenser handles, whether for discharging aerosols from a pressurized container or for operating a pump mechanism to drive a spray out a nozzle, have been known for many years. Typically the container vessel is in the form of a cylindrical can, or largely cylindrical bottle containing the fluid to be dispensed. A nozzle is provided at one end of the cylinder, usually with the opening of the nozzle oriented to spray radially outward relative to the longitudinal axis of the container. Although some sprays are in a continuous straight-line stream, generally the spray leaving the nozzle has a cone shaped zone of coverage. There are three common types of nozzle. The first type is the standard stub nozzle found on gas propellant aerosol containers used in many applications, from automotive touch-up paint to insect repellent. These nozzles are generally actuated by being pressed inwardly along the longitudinal axis of the container. The second type, is also for gas propellant aerosol containers such as those used to dispense expanding foam sealant. This kind of nozzle is supplied with a relatively large, and lengthy angled tube, the nozzle valve being actuated by lateral deflection of the top of the nozzle from the container centreline. The third kind of common nozzle has a reciprocating pump element that is worked by longitudinal pressing.

As pertains to the first and third types of nozzle, existing handles may not be entirely satisfactory. Examples of known spray handles of the inventor Brody are shown in U.S. Pat. No. 4,805,812 issued Feb. 21, 1989; U.S. Pat. No. 5,086,954 issued Feb. 11, 1992; and U.S. Pat. No. 5,323,937 issued Jun. 28, 1994 . Also known are U.S. Pat. No. 4,432,474 to Hutchinson et al., issued Feb. 21, 1984 and U.S. Pat. No. 4,401,240 to Brack, issued Aug. 30, 1983. Each of these documents shows an actuating handle for use with a stub nozzle on a standard gas propellant aerosol spray can. The first four of these patents show fittings for removable attachment to the neck ring of the spray can, and, in the fifth instance, a releasable fitting for engaging the body of the can near its upper end. All five have handles which extend rearwardly from the can, that is, in the opposite direction from the spray, and have a moving member akin to a trigger. Motion of the trigger causes the stub nozzle to be depressed, thus allowing a spray of fluid to escape.

In each case the centre of gravity of the can, fluid, and propellant, if any, is well offset from the handle, such that a person wishing to spray a vertical wall, for example, must also apply a bending moment when holding the can to keep it properly oriented. This may place undue stress on the wrist and forearm, and may be uncomfortable. An uncomfortable operator may not spray with the same precision or consistency over time. It would be advantageous to grasp the can relatively close to its centre-of gravity.

Furthermore, in each of the rearwardly depending handle examples noted above, the handle includes a stationary part and a movable trigger part so that the fingers grasp the trigger and the palm of the hand engages the stationary part, the nozzle being operated when the two parts are squeezed together. It would be advantageous to eliminate the stationary part of the handle, and use the can itself as the reacting member.

U.S. Pat. No. 3,987,942 issued Oct. 26, 1976 to Morane et al., shows an handle mechanism for operating an aerosol spray nozzle, that handle extending downwardly along the forward side of the aerosol can such that an operator may grasp the can and handle and squeeze them together. The Morane et al., device appears to have relatively complicated molded parts, and does not spray through or past the handle, but rather ducts the fluid through a long, narrow passageway as shown in FIG. 2 thereof as item 8b or in FIG. 9 as item 26. Such a nozzle may not be suitable for use with materials which are likely to clog between uses—such as paints or adhesives for which a shorter nozzle may be desired. Further, while the Morane et al., handle is removable and interchangeable from its own fitting, the can fitting itself does not appear to be intended to be moved from can to can.

U.S. Pat. No. 4,915,263 issued Apr. 10, 1990 to Corba also shows a forwardly depending trigger assembly for a spray nozzle. In this instance the assembly is for operating a pump type nozzle, and the nozzle exit extends forwardly of the handle. The relatively complex parts illustrated do not appear to be suited for use with, or rapid interchange between, standard spray cans.

U.S. Pat. No. 4,077,548 and U.S. Pat. No. 4,077,549 both issued Mar. 7, 1978 to Beard. They show threadably removable pump assemblies mounted to containers. FIGS. 5 and 6 of '548 show a trigger assembly with a push button 59 having a nozzle 60 mounted to the pump assembly. The trigger body portion 61 is bifurcated to straddle the push button. The push button is pulled down using a saddle in the form of a cap 64, fitted tightly on the top of the push button, the cap being connected to the sides of the body portion by links 65 (one on each side). The handles terminate near the neck of the container, rather than well down the body.

An interchangeable actuator with a levered handle would also be advantageous for use with compressed materials such as expandable foam sealants. At present a number of expandable foam sealants are sold in compressed gas containers, the packaging including a threaded spout generally aligned with the longitudinal axis of the can, and a plastic nipple to be mounted on the spout. The nipple typically has an angled arm which feeds an extended discharge tube. An operator positions the outlet of the tube in a location in which foam is desired, and then deflects the spout laterally to cause the foam to be released. The nipple and tube may be supplied either as a monolithic plastic part, or as parts to be assembled.

Use of these foam sealant dispensers may sometimes result in less than optimal distribution. The foam, which can easily coat hands and clothes, is not necessarily given to easy cleaning or removal. As a precaution, at least one manufacturer includes a pair of disposable plastic gloves with its product. It would be advantageous to have a removable handle, interchangeable from can to can, for controlling the dispensing of this foam.

There is, therefore, a need for an improved, relatively simple actuator assembly.

DISCLOSURE OF INVENTION

The present invention relates to a nozzle actuator for use with a container having a nozzle, the actuator being suited to be attached to the container and having an handle hanging down the same side of the container as that to which a spray or stream of material leaves the nozzle, such that a person holding the container in the palm of their hand may grasp the handle with the fingers of the same hand and operate the nozzle while the centre of gravity of the container is held near the centre of the hand.

In a first aspect of the invention, there is an actuator for use with a container for holding contents to be dispensed, the container having a longitudinal axis and a displacement activated nozzle whence the contents can be released in a direction having a radial component relative to the axis, the actuator comprising a fitment for attachment to the container; a nozzle displacing member connected to the fitment; an handle connected to the nozzle displacing member and having an operator engageable portion locatable in spaced relationship from the container in the direction of the radial component; the handle having a passage to permit material emanating from the container to traverse the handle; and the handle movable to cause the nozzle displacing member to displace the nozzle and release the contents.

In a second aspect of that the invention, the actuator is a removably attachable fitment for removable attachment to the container.

In a third aspect of the invention there is an actuator for use with an aerosol spray container having a stub nozzle oriented to spray in radial direction defined as a forward direction, the actuator comprising a removable fitment for attachment to the container; a pressing member connected to the fitment for contacting the stub nozzle; an handle extending from the pressing member; the handle having a gripping portion locatable in spaced relationship adjacent a forward region of the container; and the handle having a shape to permit unobstructed passage of spray emanating from the nozzle.

In yet another aspect of the invention there is an actuator for use with a pressurized container for holding contents to be dispensed, the container having a longitudinal axis and a displacement activated nozzle and nozzle discharge tube whence the contents can be released in a direction having a radial component relative to the axis, the actuator comprising a fitment for attachment to the container; a nozzle displacing member connected to said fitment; an handle connected to the nozzle displacing member and having an operator engageable portion locatable in spaced relationship from the container in the direction of the radial component; the handle having a passage to permit the discharge tube to traverse the handle; and the handle movable to cause the nozzle displacing member to displace the nozzle and release the contents.

DETAILED DESCRIPTION OF THE INVENTION

Figure 2:
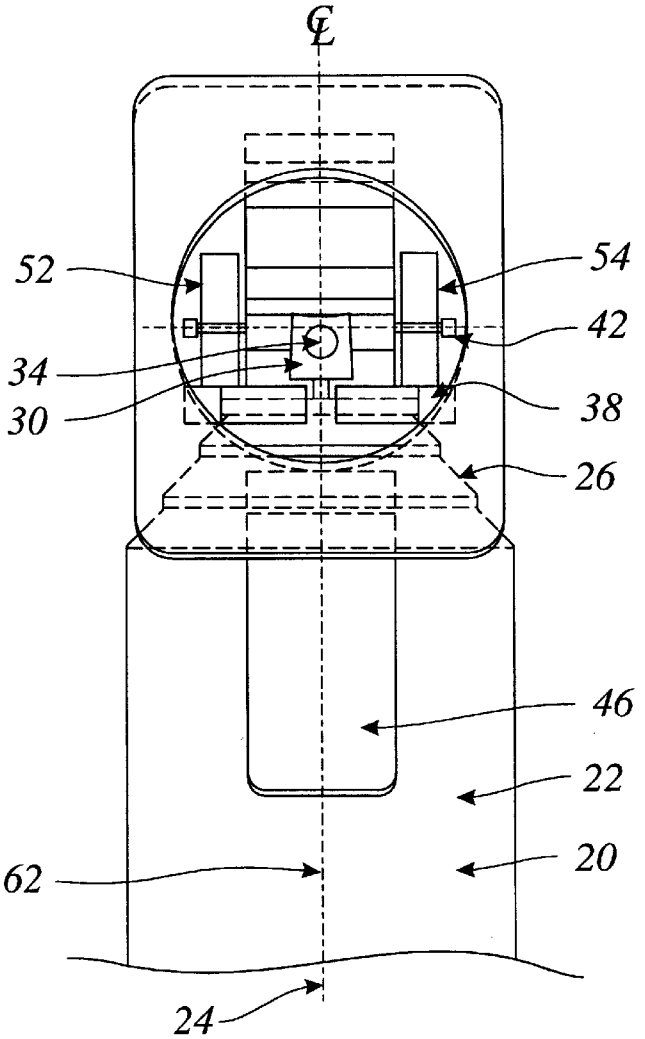
FIG. 2 is a frontal view of the spray actuator of FIG. 1.

In the description which follows, like parts are marked throughout the specification and the drawings with the same respective reference numerals. The drawings are not necessarily to scale and in some instances proportions may have been exaggerated in order more clearly to depict certain features of the invention.

Figure 1:
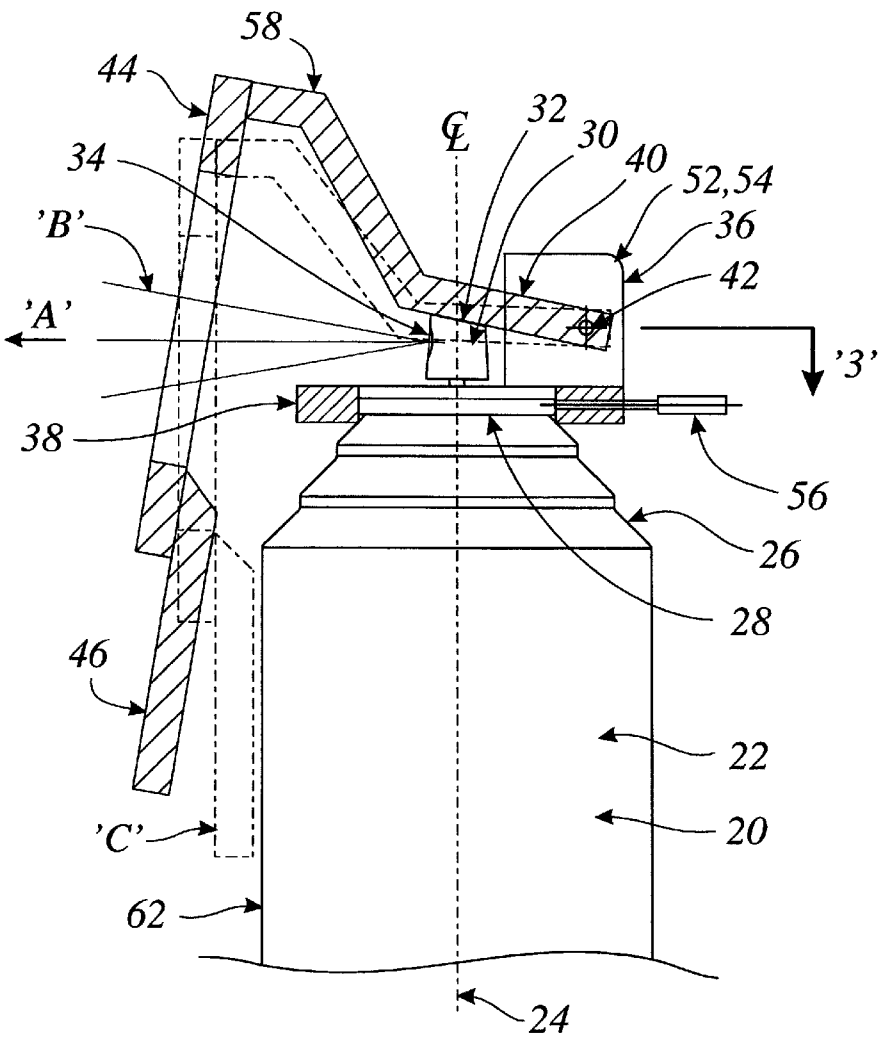
FIG. 1 is a profile, in section, of an embodiment of a spray actuator according to the present invention shown mounted to a spray container.

A standard compressed gas aerosol can is indicated in FIGS. 1 and 2 as 20. It has a cylindrical body 22 having a longitudinal axis 24, and a dispensing end 26 having a standard diameter ring fitting 28 and a centrally located stub nozzle, or push button nozzle 30, having a top surface 32 for pressing, and an aperture 34 whence spray departs can 20 radially, generally in a conical form. For the purposes of this description, the forward direction is the direction in which the spray flows, and is indicated by arrow 'A'.

A first embodiment of an actuator for use with can 20 is indicated generally as 36 in FIGS. 1 and 2. Actuator 36 has a fitment 38 for attaching to ring fitting 28, a push button pressing member 40 pivotally linked to fitment 38 by an hinge pin 42, and an handle 44 connected to, and extending forwardly and downwardly of, pressing member 40, handle 44 itself having a rearwardly recessed hand grip 46.

Figure 3:
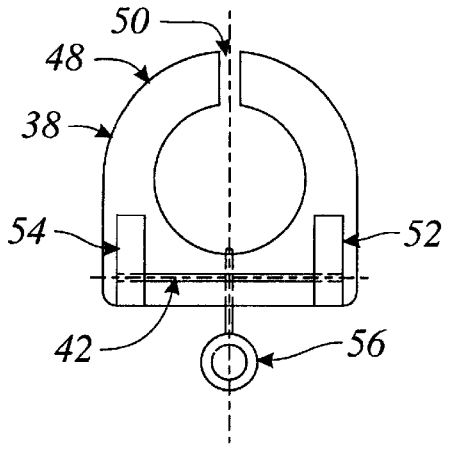
FIG. 3 is a plan view, in detail, of a fitment of the actuator of FIGS. 1 and 2.

As shown in FIG. 3, fitment 38 has a flange in the form of a split ring 48 with a gap 50, for seating about ring fitting 28; and a parallel, spaced apart pair of upstanding legs 52 and 54 which form a clevis for receiving hinge pin 42, about which pin pressing member 40 may pivot. A thumb screw 56 is threaded into, and through, split ring 48 opposite gap 50, by which means split ring 48 may be tightened onto ring fitting 28.

Pressing member 40 has an upward crook 58 for location forward of push button nozzle 30; handle 44 being mounted to, and hanging from, the distal end of crook 58. As seen in FIG. 2, handle 44 has a central, circular aperture 60 of a size sufficient comfortably to avoid the conical zone of spray, indicated as 'B'. Thus it is intended that spray emanating from nozzle 30 may flow unimpeded in the direction of arrow 'A' toward a chosen object, traversing the profile of handle 44 as it does so.

In use, actuator 36 is mated to a standard container by seating split ring 48 about ring fitting 28 as shown, and tightening thumb screw 56. Pressing member 40 is positioned in contact with push button nozzle 30, with handle 44 extending downwardly adjacent and spaced somewhat away from the forward side 62 of the cylindrical body of can 20. Can 20 is held in the palm of the hand, with thumb hooked around the back. The operator's fingers are outstretched to curl around hand grip 46. In such a position the centre of gravity of can 20 and its contents will in general be within the envelope of the hand, or very close to it, such that the effort required to hold can 20 in a chosen orientation may tend to be less than for a can cantilevered out from a trigger-type handle. Squeezing handle 46 either partly or fully rearwardly relative to can 20 toward full open operating position 'C', indicated in dashed lines in FIG. 1, causes the spray to exit can 20.

The length of handle 44, extending a substantial distance along cylindrical body 22 gives it a large mechanical advantage over the relatively short lever arm from the contact of pressing member 40 against push button nozzle 30 to the fulcrum point at hinge pin 42. Furthermore, handle 44 may be grasped by several fingers at once, allowing an operator to bring the musculature of the entire hand to bear, most probably with greater control sensitivity than when pressing a standard nozzle downward with a single thumb or finger, and with a decreased likelihood of the operator's hand, fingers, or thumb coming in contact with, for example, spray or drips of paint, glue or other substances emanating from aperture 34.

Figure 5:
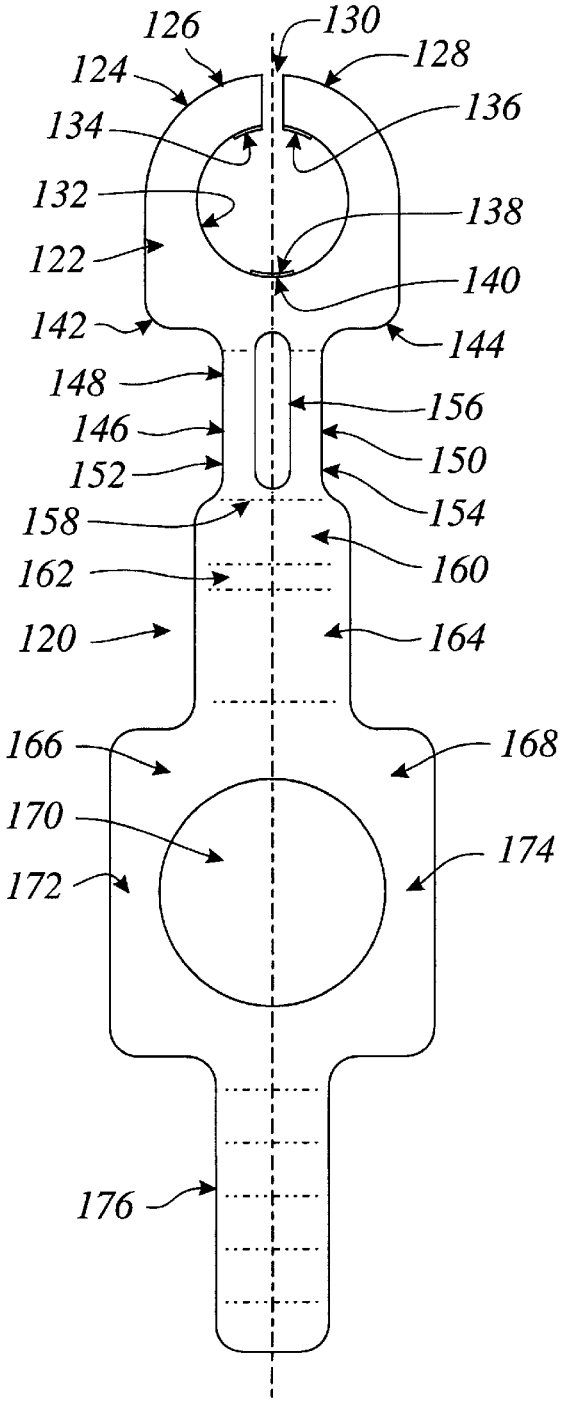
FIG. 5 is developed view of the actuator of FIG. 4.
Figure 4:
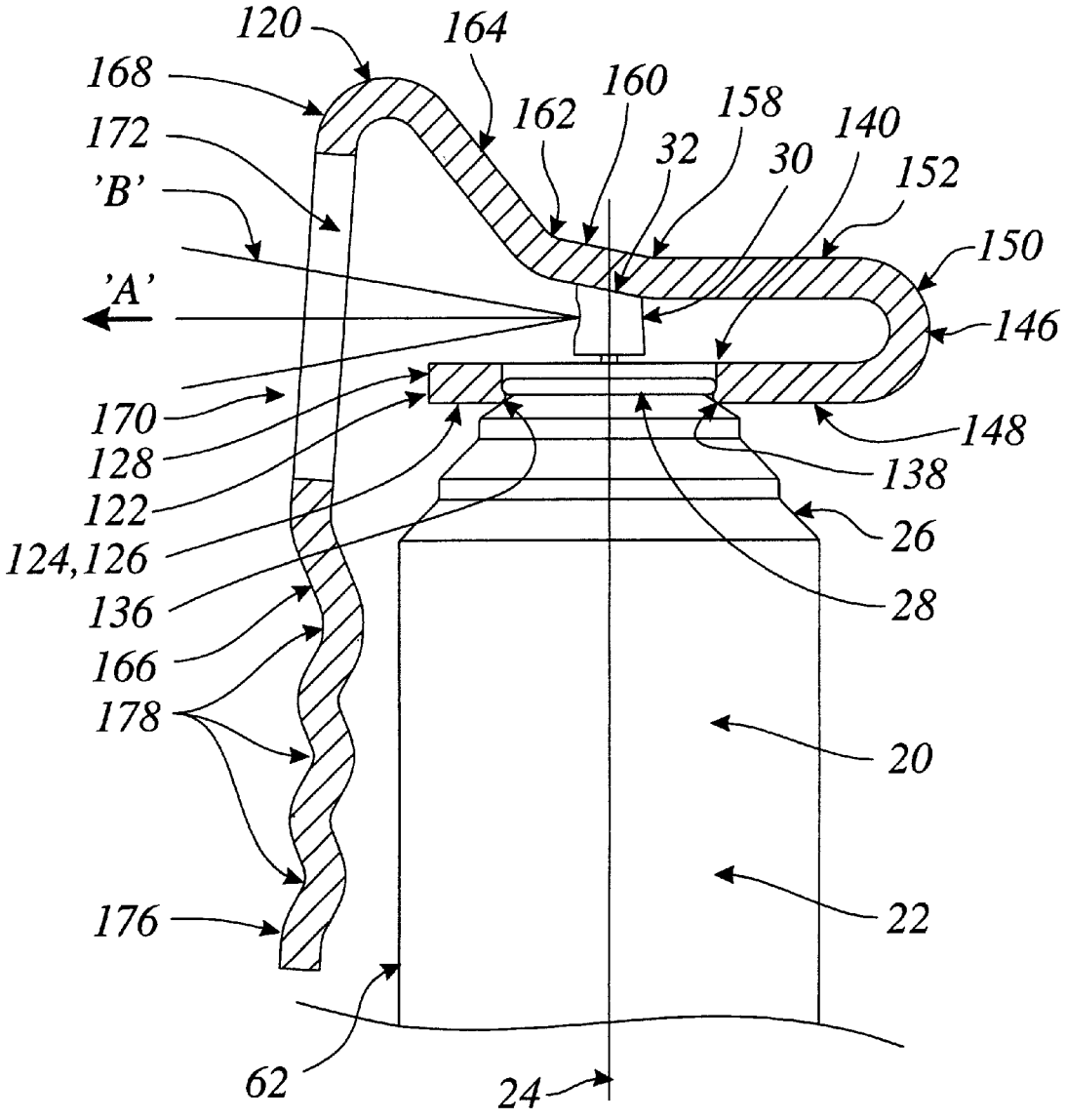
FIG. 4 is a profile view of an alternate embodiment of spray actuator according to the present invention, also shown mounted to a spray container.

An alternative embodiment of a spray actuator is shown in FIGS. 4 and 5. This embodiment shows a single piece actuator generally as 120 made from a material of substantially constant thickness. As before, it has a fitment 122 of a size for seating in an interference fit about ring fitting 28, fitment 122 having a split ring flange 124 terminating in toes 126 and 128 separated by a gap 130. Split ring flange 124 has an inward face 132 of a radius corresponding to the diameter of ring fitting 28, or slightly less, to yield an interference. Three blisters, 134, 136, and 138, extend inwardly of face 132 near toes 126 and 128, and near the crotch 140 of flange 124 respectively, and are intended have a snap fit under ring fitting 28 against dispensing end 26. To that end, removal of fitment 122 from ring fitting 128 is facilitated by the generally squared corners 142 and 144 of flange 124, against which a person holding can 20 may push with their thumbs to urge blister 138 past ring fitting 128, thereby releasing actuator 120 from can 20.

Although inward face 132 extends about substantially the entire circumference of ring fitting 28, leaving only small gap 130 a larger gap could be used, and need not have a contacting substantially annular fitting, like flange 122. Rather, a fitment having a continuous arc, or intermittent contact feet, engaging comfortably more than 180 degrees of arc of ring fitting 28, thereby capturing it, would be sufficient. For example, a fitment having three or four contact feet on 120 or 90 degree centres, respectively could be used.

Fitment 122 further includes a resilient member 146 extending rearwardly from flange 128, having a rearward run portion 148, a continuously curved 180 degree reverse bend 150, and a forward run portion 152. Resilient member 146 acts as a spring, and while resilient is more compliant than adjoining portions of actuator 120 generally.

Forward run portion 152 of resilient member 146 of actuator 120 terminates at an upward crimp 158 giving onto a nozzle pressing member 160, angled forwardly upward at a convenient angle for meeting top surface 32 of nozzle 30. Pressing member 160 is in turn connected at upward bend 162 to a crook 164 whence a handle 166 depends in a generally downward direction.

Handle 166 has an upper plate 168 pierced by a central aperture 170 leaving side webs 172 and 174, aperture 170 again being of suitable size to avoid impingement by spray cone 'B'. Handle 166 further includes a finger grip 176 depending from plate 168, finger grip 176 being provided with a number of undulations 178 to be engaged by the fingers of an operator.

Figure 6:
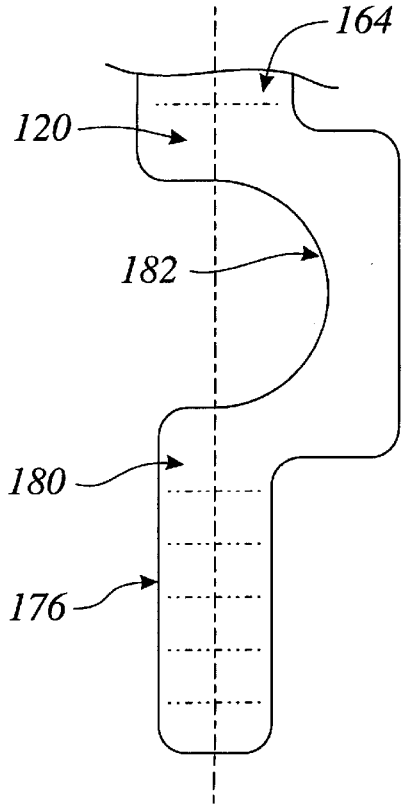
FIG. 6 shows an alternative, asymmetric handle for use with the actuators of either FIG. 1 or FIG. 4.

A further alternative handle is shown in the detail of FIG. 6. An asymmetric handle 180 having a dog-leg 182 to avoid the envelope of conic spray zone 'B' is shown depending from crook 164, and terminating in finger grip 176 as before. Handles of various configurations, whether straight-legged, semi-circular, or arbitrarily curved, could be chosen which extend forwardly of the point of commencement of cone 'B' at nozzle aperture 34, provide in all cases that the handle is shaped to avoid the envelope of conical spray zone 'B', whether by having an aperture with a closed perimeter, such as a circle or oval hole, or an open sided bight such as an U-shaped channel, dog-leg or semi circle, thereby leaving an allowance, or passageway by which spray from behind the handle is able to traverse the profile of the handle in the direction of arrow 'A'. A symmetrical aperture and supporting structure is convenient since it tends to discourage twisting such as might occur with an asymmetric handle.

The function of blisters 134, 136 and 138 could probably be achieved with a continuous counterbore of slightly smaller radius than face 132, a ridge, a ledge, a number of dimples, or lips, or tongues, or teeth, of chosen dimension to give a satisfactory snap and while not being so tight-fitting as to be excessively difficult to remove from ring fitting 28. A standard size of pressurized aerosol can neck ring fitting is about 1.28 inches in outside diameter, and this is the size of fitting intended to be engaged by blisters 134, 136, and 138. The principles of the invention would apply equally to other sizes of neck ring fittings.

The springiness of resilient member 146 can be altered by changing its length, the width or neck 154, the proportions of slot 156, and the local thickness of the material. One need not use both neck 154 and slot 156, but could use one or the other, or both as may be found satisfactory. The use of resilient member 146 permits the elimination of pivoting hinge of the embodiment of FIGS. 1 and 2.

Actuator 120 is shown as having been formed from a flat sheet of uniform thickness, cut and bent to shape. It could be a molded plastic part made, for example, from a polycarbonate plastic. It could also be made of a relatively thinner metal or plastic part incorporating stiffening ribs. It could be made as a sheet metal stamping, and depending on the geometry chosen, with drawn or bent reinforcing flanges.

Figure 7:
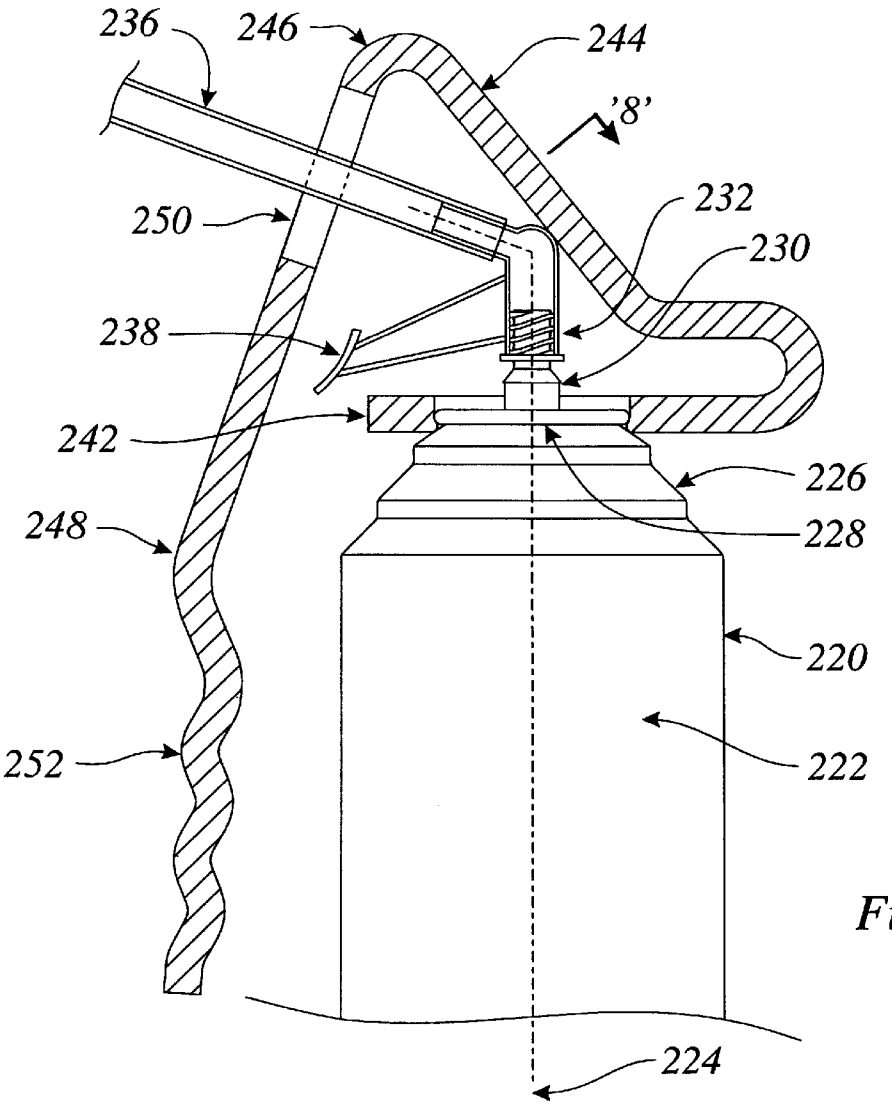
FIG. 7 shows a profile view analogous to FIG. 1, of a second alternate embodiment of actuator according to the present invention as mounted to a standard expandable foam third embodiment container.

In FIG. 7 a compressed gas container, such as might contain expandable foam sealant, is shown as 220, and has a cylindrical body 222 having a longitudinal axis 224, surmounted by a dispensing end cap 226 itself having a stand ring fitting 228 and coaxial a threaded discharge valve spout 230. A matingly threaded, angled spigot 232 is attached to spout 230, and has an angled arm 234 whence an applicator tube 236 extends to some distance, for example 6 to 8 inches. Spigot 232 may also include an integrally molded plastic handle 238. When spigot 232 is bent away from axis 224 the matter under pressure in container 220 is permitted to flow out through tube 236, the rate of flow being a function of the angle of deflection.

Figure 8:
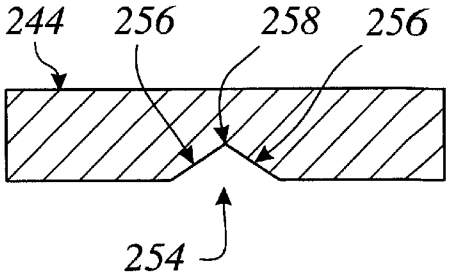
FIG. 8 shows a detail of the actuator of FIG. 7.

An interchangeable actuator is shown generally as 240 and includes a fitment for seating about ring fitting 228 which corresponds in all material respects to items 122 through 158 described above. It differs from actuator 120 in that actuator 240 has a spigot contacting member 242 for deflecting spigot 232 away from axis 224, rather than for pressing a stub nozzle longitudinally towards the body of a can a described above. Contacting member 242 terminates at its foremost end at a curled portion 244 which connects it to an handle 246 having an aperture 248 through which tube 236 can pass; and a handgrip 250, substantially similar to item 166 described above. As seen in the detailed view if FIG. 8, contacting member 242 is preferably provided with a guide channel 252 along which spigot 232 may be engaged, channel 252 acting to discourage wandering.

In use, a rearward pull on hand grip 250 will cause contacting member 242 to push against spigot 232, thus releasing the contents of container 220. Although contacting member 242 is shown as a substantially straight faced part, it acts against spigot 232 in the manner of a cam against a cam follower and could have any chosen cam profile such as may be found satisfactory. Similarly, although a single piece part is shown, a two piece part with hinge could be used.

Further, although channel 252 is shown with straight-sided included flanks 254 meeting at an apex 256, a different cross-section, whether flat sided, semi circular, or some other profile, could be used.

A preferred embodiment has been described in detail and a number of alternatives have been considered. As changes in or additions to the above described embodiments may be made without departing from the nature, spirit or scope of the invention, the invention is not to be limited by or to those details, but only by the appended claims or their equivalents.

I claim:

1. An actuator for use with an aerosol container for holding contents to be dispensed under pressure, the container having a longitudinal axis, a neck ring and a displacement activated stub nozzle whence the contents can be released in a direction having a radial component relative to the axis, the direction of the radial component defining a forward direction, said actuator comprising:

a fitment for attachment to the neck ring of the container;

said fitment having portions for engaging the neck ring both forwardly and rearwardly of the stub nozzle;

a nozzle displacing member connected to said fitment rearwardly of the stub nozzle;

said nozzle displacing member having a forwardly and upwardly extending portion locatable to pass over the stub nozzle, said forwardly and upwardly extending portion having a surface for bearing upon the stub nozzle;

a handle connected to said forwardly and upwardly extending portion of said nozzle displacing member, and depending therefrom;

said handle having an upper portion extending from said forwardly and upwardly extending portion of said nozzle displacing member, said upper portion of said handle being located to extend, in use, forwardly and downwardly of said surface for bearing against the stub nozzle, and an operator engageable portion depending from said upper portion, said operator engageable portion being of sufficient length to lie in spaced relationship from the container in the forward direction below the level of the neck ring in a position to permit the finger's of a user's hand to engage said operator engageable portion forwardly of the container while another portion of the user's hand engages a rearward part of the container;

said upper portion having a passage defined therein to permit a cone of spray emanating from the stub nozzle to pass therethrough unobstructed; and said handle being movable to cause said nozzle displacing member to displace the nozzle and release the contents.

2. The actuator of claim 1 wherein said fitment is a removably attachable fitment for removable attachment to the container.

3. The actuator of claim 1 wherein said passage is chosen from the set of:

a) an aperture; and b) a bight.

4. The actuator of claim 1 wherein said actuator is chosen from the set of actuators having a) said nozzle displacing member and said handle made from a single piece of material; and b) said handle, said nozzle displacing member, and said fitment made from a single piece of material.

5. The actuator of claim 1 wherein said nozzle displacing member is connected to said fitment by a member chosen from the set of:

a) a resilient member; and b) an hinge.

6. The actuator of claim 1 wherein said upper portion of said handle includes a flat plate and said passage is in the form of an aperture formed centrally therein.

7. The actuator of claim 1, the nozzle being a radial deflection activated nozzle, wherein said nozzle displacing member is oriented relative to the handle for contacting the nozzle laterally relative to said axis.

8. The actuator of claim 1, the nozzle being a longitudinally activated nozzle, wherein said nozzle displacing member is a nozzle pressing member for pressing the nozzle along the axis.

9. The actuator of claim 1 wherein said lower portion and said upper portion are formed from a continuous sheet of material, said upper portion including a flat plate having an aperture formed therein to define said passage, and said lower portion including a handgrip element having a plurality of undulations for engagement by a user's fingers.

10. An actuator for use with an aerosol spray container, the container having a stub nozzle oriented to spray in radial direction defined as a forward direction, said actuator comprising:

a removable fitment for attachment to the container said fitment having portions for engaging the neck ring both forwardly and rearwardly of the stub nozzle;

a pressing member for contacting the stub nozzle, connected to said fitment rearwardly of the stub nozzle;

a handle extending forwardly and downwardly from said pressing member;

said handle having a gripping portion locatable extend in spaced relationship adjacent a forward region of the container level of the neck ring in a position to permit the fingers of a user's hand to engage said gripping portion of the handle forwardly of the container while another portion of the user's hand engages a rearward portion of the container lying below the neck ring, whereby a user can squeeze the handle toward the container; and said handle having an upper portion between said gripping portion and said pressing member, said upper portion being shaped to permit unobstructed passage of a cone of spray emanating from the nozzle.

11. The actuator of claim 10 wherein said handle has one of:

a) an aperture; and b) a bight, to permit unobstructed passage of the spray.

12. The actuator of claim 9 wherein said actuator is chosen from the set of actuators having a) said nozzle displacing member and said handle made from a single piece of material; and b) said handle, said nozzle, and said fitment made from a single piece of material.

13. The actuator of claim 12 wherein said material is of substantially constant thickness.

14. The actuator of claim 9 wherein said nozzle displacing member is connected to said fitment by a member chosen from the set of:

a) a resilient member; and b) an hinge.

15. The actuator of claim 10 wherein said upper portion of said handle includes a flat plate having an aperture formed centrally therein to permit passage of the cone of spray.

16. The actuator of claim 10 wherein said lower portion and said upper portion are formed from a continuous sheet of material, said upper portion including a flat plate having an aperture defined therein to permit passage of the cone of spray, and said lower portion including a handgrip element having a plurality of undulations for engagement by a user's fingers.

* * * * *